US008733599B2

(12) United States Patent
Hornland

(10) Patent No.: US 8,733,599 B2
(45) Date of Patent: May 27, 2014

(54) COMBINED CAP AND ACTUATOR DEVICE FOR AEROSOL CONTAINER

(71) Applicant: Lloyd Hornland, St. Albert (CA)

(72) Inventor: Lloyd Hornland, St. Albert (CA)

(73) Assignee: Lloyd Hornland, St. Albert (CA)

( * ) Notice: Subject to any disclaimer, the term of this patent is extended or adjusted under 35 U.S.C. 154(b) by 0 days.

(21) Appl. No.: 13/743,913

(22) Filed: Jan. 17, 2013

(65) Prior Publication Data

US 2013/0186911 A1 Jul. 25, 2013

Related U.S. Application Data

(60) Provisional application No. 61/588,362, filed on Jan. 19, 2012.

(51) Int. Cl.
*B65D 83/00* (2006.01)

(52) U.S. Cl.
USPC ..... 222/402.12; 222/135; 222/205; 222/207; 222/153.11; 222/402.13

(58) Field of Classification Search
CPC ..... B05B 1/28; B65D 83/16; B65D 83/20; B65D 83/205; B65D 50/00; B65D 83/224; B65D 83/226; B65D 83/228; B65D 83/30; B65D 83/303; B65D 83/306; B65D 83/68
USPC ..... 222/135, 153.11, 205, 207, 402.11, 222/402.12, 402.13
See application file for complete search history.

(56) References Cited

U.S. PATENT DOCUMENTS

| | | | | | |
|---|---|---|---|---|---|
| 104,275 | A | * | 6/1870 | Corell | 222/538 |
| 1,323,858 | A | * | 12/1919 | Harwood | 222/205 |
| 2,707,968 | A | | 5/1955 | Efford | |
| 2,913,749 | A | | 11/1959 | Ayres | |
| 3,001,524 | A | | 9/1961 | Maison et al. | |
| 3,012,555 | A | | 12/1961 | Meshberg | |
| D198,308 | S | | 6/1964 | Byford | |
| 3,168,059 | A | * | 2/1965 | Germann | 425/181 |
| 3,180,532 | A | * | 4/1965 | Michel | 222/182 |
| 3,184,115 | A | | 5/1965 | Meshberg | |
| 3,203,454 | A | | 8/1965 | Micallef | |
| 3,228,567 | A | | 1/1966 | Abplanalp | |
| 3,266,676 | A | * | 8/1966 | McKernan | 222/182 |
| 3,351,418 | A | | 11/1967 | Karnuth | |
| 3,387,911 | A | * | 6/1968 | Focht | 401/190 |
| 3,456,851 | A | * | 7/1969 | Skora et al. | 222/205 |
| 3,738,537 | A | * | 6/1973 | Gach | 222/153.11 |
| 3,744,678 | A | | 7/1973 | Beres et al. | |

(Continued)

FOREIGN PATENT DOCUMENTS

| | | | | |
|---|---|---|---|---|
| CA | 1288391 | | 9/1991 | |
| CA | 2654696 | | 12/2006 | |
| GB | 2181489 | A * | 4/1987 | B65D 83/14 |

*Primary Examiner* — Frederick C Nicolas
*Assistant Examiner* — Patrick M Buechner
(74) *Attorney, Agent, or Firm* — Bennett Jones LLP

(57) ABSTRACT

A combined cap and actuator device for an aerosol container has a body which is substantially cylindrically-shaped having a receiving portion, an actuating portion, and a waist portion. The body is reversible from an unactuating position wherein the valve of the aerosol container is closed to prevent product flow, to an actuating position wherein the valve is opened to dispense product into the receiving portion. A lid is attachable to seal the receiving portion, actuating portion or base of the container.

11 Claims, 8 Drawing Sheets

(56) References Cited

U.S. PATENT DOCUMENTS

| | | | | | |
|---|---|---|---|---|---|
| 3,765,573 | A | * | 10/1973 | Landsman | 222/182 |
| 3,770,170 | A | | 11/1973 | Hayes | |
| 3,792,802 | A | | 2/1974 | Gores | |
| 3,841,532 | A | | 10/1974 | Gores | |
| 3,884,393 | A | * | 5/1975 | Wassilieff | 222/153.02 |
| 3,917,127 | A | * | 11/1975 | Berenstain | 222/402.13 |
| 3,935,974 | A | * | 2/1976 | Weyn | 222/402.13 |
| 4,186,853 | A | * | 2/1980 | White | 222/182 |
| 4,195,756 | A | * | 4/1980 | Campbell | 222/182 |
| 4,226,339 | A | * | 10/1980 | Landsman et al. | 222/182 |
| D269,250 | S | | 6/1983 | Berghash | |
| 4,420,099 | A | | 12/1983 | Pizzurro et al. | |
| 4,426,025 | A | * | 1/1984 | Knickerbocker | 222/182 |
| 4,792,062 | A | * | 12/1988 | Goncalves | 222/135 |
| 4,823,986 | A | * | 4/1989 | Pearce, III | 222/54 |
| 4,978,035 | A | * | 12/1990 | Morane et al. | 222/108 |
| 5,186,364 | A | | 2/1993 | Laszlo | |
| 5,415,488 | A | | 5/1995 | MacGibbon et al. | |
| 6,000,579 | A | * | 12/1999 | Sugimoto et al. | 222/108 |
| 6,021,927 | A | * | 2/2000 | Nomiyama et al. | 222/402.14 |
| 6,283,337 | B1 | | 9/2001 | Nakamura et al. | |
| 6,338,424 | B2 | | 1/2002 | Nakamura et al. | |
| 2009/0045223 | A1 | * | 2/2009 | Laidler et al. | 222/108 |
| 2010/0147898 | A1 | * | 6/2010 | Blumenstein et al. | 222/402.13 |

* cited by examiner

COMBINED CAP AND ACTUATOR DEVICE FOR AEROSOL CONTAINER

CROSS REFERENCE TO RELATED APPLICATIONS

This application claims the priority benefit of U.S. Provisional Patent Application No. 61/588,362 filed on Jan. 19, 2012 entitled "Combined Cap and Actuator Device for Aerosol Container," the contents of which are incorporated herein by reference.

FIELD OF THE INVENTION

The present invention is directed to a combined cap and actuator device for an aerosol container.

BACKGROUND OF THE INVENTION

It is common for aerosol products to be released as a spray for broad coverage on a variety of surfaces or as foam into the hands of the user for application, as it would be done with shaving products. However, the resulting dispersal of product can be wasteful, with unused product (for example, shaving cream) being rinsed away. Skin tone enhancers, instant tanning lotions, and hair coloring are examples of products which discolor the hands and with which human contact is preferably minimized. Product in the form of an expanding foam dispensed from an aerosol container usually collects in the overcap of the container, or spills down the sides of the container onto a surface such as, for example, a shelf, basin, or bathroom countertop. Aerosol paints typically cover larger areas, but are less effective when smaller touch-ups are warranted. Conventional aerosol applicators do not allow for the complete containment of a product while being mixed with a grooming or cosmetic tool. The overcaps of aerosol containers do not presently allow the contained product and applicator to be sealed together and stored or moved between locations. Accordingly, there is a need in the art for an improved dispenser cap for aerosol containers which mitigates these problems.

SUMMARY OF THE INVENTION

The present invention relates to a combined cap and actuator device for an aerosol container. In one aspect, the invention comprises a device for removably mounting on an aerosol container comprising a valve, the device comprising:

a) a body which is substantially cylindrically-shaped comprising a receiving portion, an actuating portion, and a waist portion disposed there between, the body being reversible from an unactuating position wherein the valve is closed to prevent product flow, to an actuating position wherein the valve is opened to dispense product into the receiving portion; and b) a lid removably attachable to seal the receiving portion, actuating portion or base of the container.

In one embodiment, the receiving portion comprises side walls defining a bore, a first open end comprising a first outer annular shoulder sized to receive the lid, a first inner annular shoulder capable of mating with a rim of the container, and a second inner annular shoulder larger than the first inner annular shoulder.

In one embodiment, an end wall joins the side walls to separate the receiving portion from the actuating portion. In one embodiment, the end wall defines at least one hollow protuberance configured to receive and frictionally engage at least one valve stem of the container. In one embodiment, a generally dome-shaped deflector comprising one or more apertures is connected to the end wall in position over the protuberance. In one embodiment, the device comprises two protuberances and two deflectors.

In one embodiment, the actuating portion comprises tapered walls, and a second open end comprising a second outer annular shoulder sized to receive the lid, and a third inner annular shoulder capable of mating with a rim of the container.

In one embodiment, the waist portion comprises a plurality of collapsible joints. In one embodiment, the waist portion comprises a circumferential tear away band carrying an outwardly protruding pull tab integrally formed therewith.

In one embodiment, the lid comprises a removable portion and a flange. In one embodiment, the device comprises sloping walls replacing the waist portion and side walls. In one embodiment, the device comprises an elastomer.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

Figure 1:
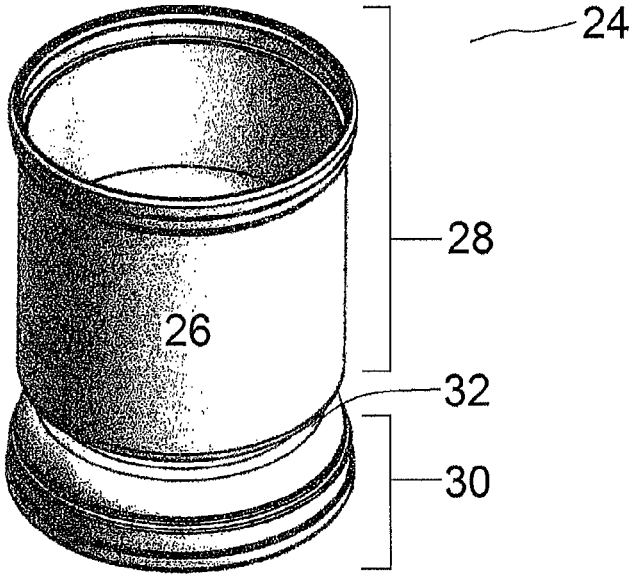
FIG. 1 is a perspective view of one embodiment of the present invention.

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

The present invention comprises a combined cap and actuator device for engagement with the top end of a cylindrical steel or aluminum container, such as an aerosol container. As used herein, the term "aerosol container" refers to an integral air-tight, pressurized package incorporating a valve and a product which is dispensed as a fine mist, spray or foam in a controlled manner when the valve is operated. The aerosol container (10) has a container body (12) having a rolled or turned annular rim (14), a cone (16), and valve cup (18) through which a valve stem (20) protrudes upwardly under the effect of resiliency of a spring (not shown) disposed within a valve (not shown) mounted in the container body (12). The valve is thus normally biased toward its closed position by the spring, but is urged open by vertical depression of the actuator button atop the container (10). The actuator button covers the valve stem (20) and has a nozzle (not shown) from which the product (22) is discharged. By depressing the actuator button downward in an axial direction of the valve stem (20), the valve is urged open. Since the pressure outside the container (10) is less than the pressure inside, propellant within the container (10) expands, pushing the product (22) up a dip tube (not shown) mounted within the container (10) and out through the valve stem (20) and nozzle. The actuator button may be operated by a human finger. However, for certain products in aerosol containers, it is desirable to dispense the product while minimizing human contact.

As used herein, the term "product" broadly refers to any cosmetic and pharmaceutical gel, cream, or lotion including, but not limited to, shaving cream or gel, suntan or self-tanning lotion, hair gel, foam hair color, depilatory cream and foam, deodorant, face and body cream and foam, and the like.

Figure 2:
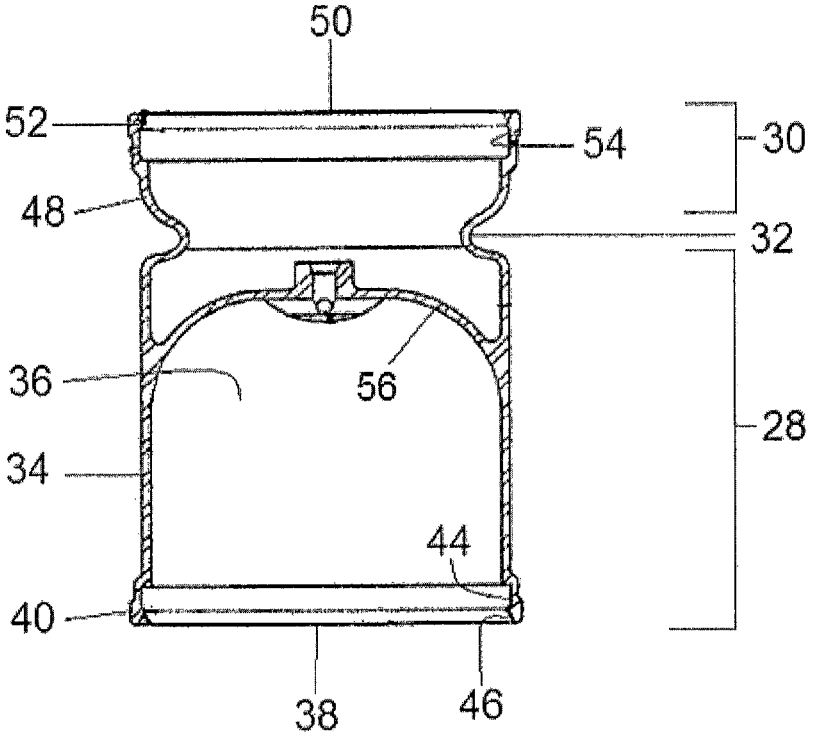
FIG. 2 is a sectional view of one embodiment of the present invention.

The combined cap/actuator device (24) of the present invention is reversible from an unactuating position wherein the valve of the container (10) is closed and no product is dispensed, to an actuating position wherein the valve is opened to dispense the product (22) within the container (10). The device (24) is shown generally in FIGS. 1 and 2 to include a body (26) which is substantially cylindrically-shaped comprising three regions along a longitudinal axis of the device (24): a receiving portion (28) and an actuating portion (30) with a narrowing or waist portion (32) disposed there between.

After manufacture, the receiving portion (28) is normally empty and is removably attached to the rim (14) of the aerosol container (10) to protect the valve stem (20) and actuating button from dust, dirt and damage, and to prevent accidental discharge of the product during transport to a store or home. The device (24) may be removed from the container (10) by the user and reversed for use. The actuating portion (30) is removably attached to the rim (14) of the aerosol container (10) and a downward force is applied to dispense the product (22) from the container (10) into the receiving portion (28) which becomes partially or entirely full of dispensed product (22).

Figure 3:
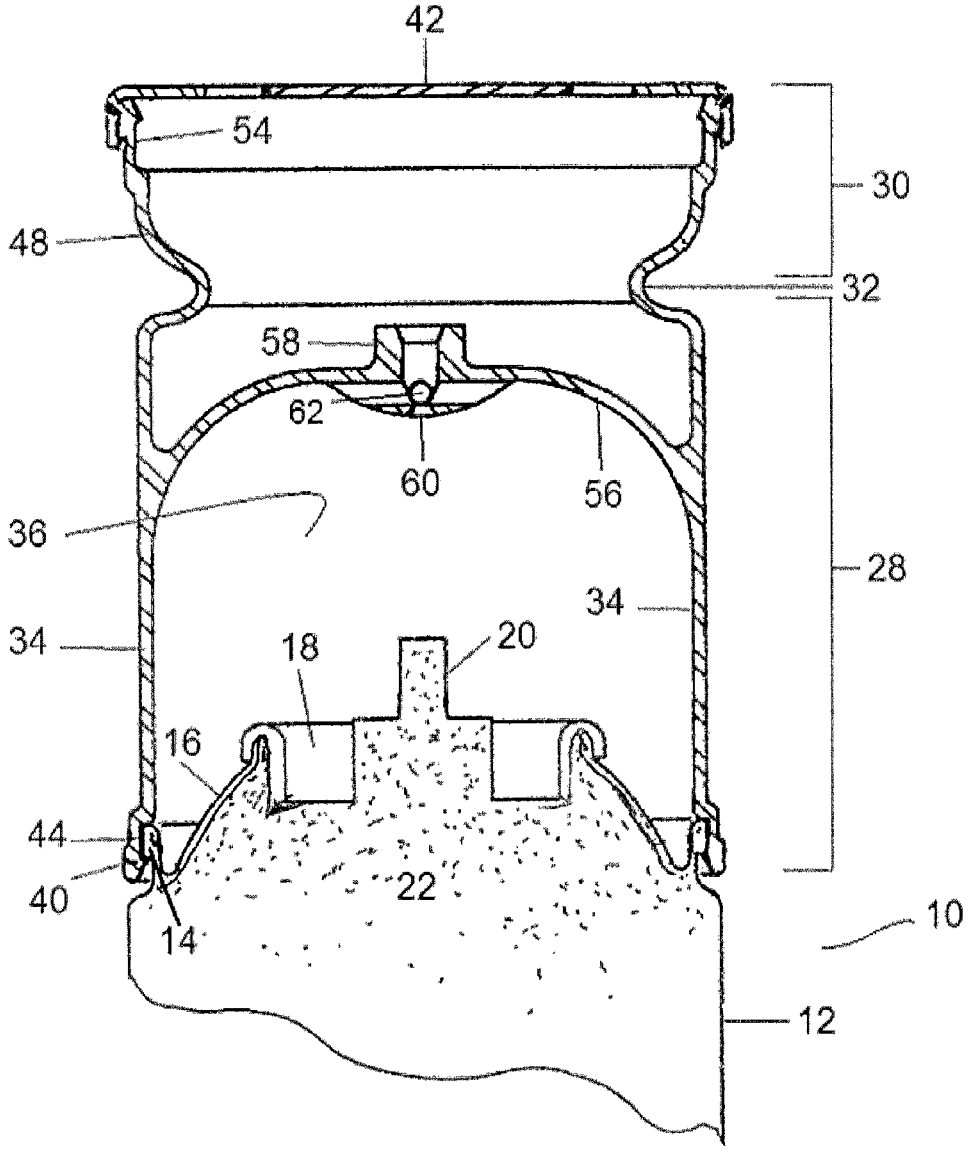
FIG. 3 is a sectional view of one embodiment of the present invention shown attached to an aerosol container in an unactuating position wherein the valve of the container is closed and no product is dispensed.

FIG. 3 shows the receiving portion (28) attached to the rim (14) of the aerosol container (10) in an unactuating position wherein the valve (not shown) of the container (10) is closed and no product is dispensed. The receiving portion (28) comprises side walls (34) which define a bore (36) within which the product (22) is received. A first open end (38) comprises a first outer annular shoulder (40) sized to receive a lid (42), and a first inner annular shoulder (44) which mates with the corresponding rim (14) of the container (10) in snap fit. A second inner annular shoulder (46) is larger than the first inner annular shoulder (44) to prevent the device (24) from sliding too far over the container (10) during assembly at the manufacturer.

The actuating portion (30) comprises tapered walls (48) and a second open end (50) comprising a second outer annular shoulder (52) sized to receive the lid (42), and a third inner annular shoulder (54) which mates with the corresponding rim (14) of the container (10) in snap fit.

Figure 4:
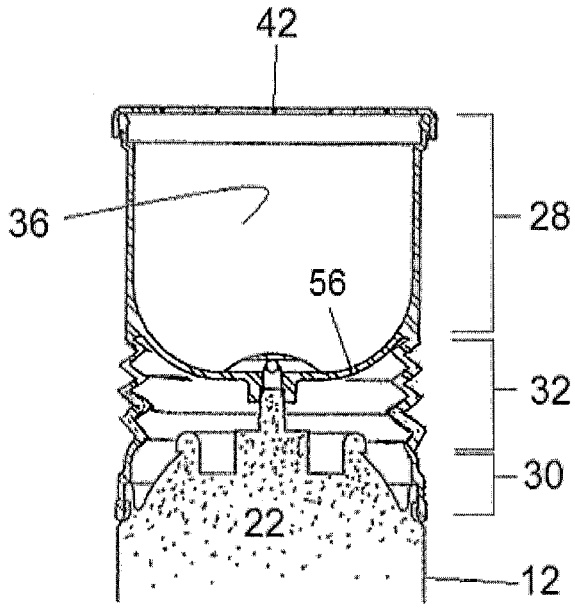
FIG. 4 is a sectional view of one embodiment of the present invention having a waist portion comprising collapsible joints.
Figure 5A:
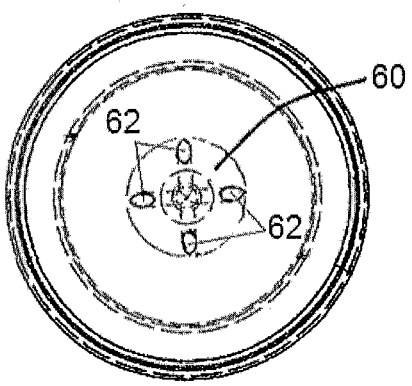
FIG. 5A is a top plan view of one embodiment of the present invention showing the deflector and apertures.
Figure 5B:
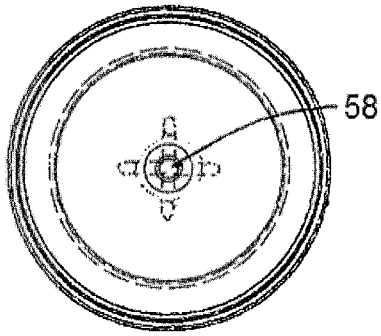
FIG. 5B is a bottom plan view of the embodiment of FIG. 5A showing the protuberance.

The waist portion (32) comprises an inwardly narrowed portion between the receiving portion (28) and the actuating portion (30), as shown in FIGS. 1-3 and 7. However, it will be appreciated by those skilled in the art that other configurations of the waist portion (32) may be suitable for the present invention. In one embodiment shown in FIG. 4, the waist portion (32) comprises a plurality of collapsible joints such as accordion elbows or pleats so as to facilitate compression of the device (24).

An end wall (56) joins the side walls (34) to separate the receiving portion (28) from the actuating portion (30). Preferably, the end wall (56) is rounded to facilitate use and mixing of the product (22) with other components. The end wall (56) defines a hollow protuberance (58) which is configured to receive and frictionally engage the valve stem (20) of the container (10). A generally dome-shaped deflector (60) comprising one or more apertures (62) is connected to the end wall (56) in position over the protuberance (58) (FIGS.

5A-B). It is contemplated that the number (density), size (diameter), shape, and positioning of the apertures (62) for the deflector (60) may vary without departing from the scope and spirit of the present invention.

As shown in FIGS. 6A-D, the device may be provided with a lid or cover (42) which comprises a removable portion (64) and a flange (66). The removable portion (64) comprises a snap-out section which is separable from the remainder of the lid (42) by perforation lines (68). The perforation lines (68) comprise a plurality of apertures or perforations. It is contemplated that the number (density), size (diameter), shape, and positioning of the apertures or perforations may vary without departing from the scope and spirit of the present invention. The perforation lines (68) define the geometry of the snap-off section. Preferably, the snap-off section is circular to accommodate a grooming or cosmetic tool including, but not limited to, a shaving brush, makeup brush, applicator, wand, stir stick, and the like.

Figure 6A:
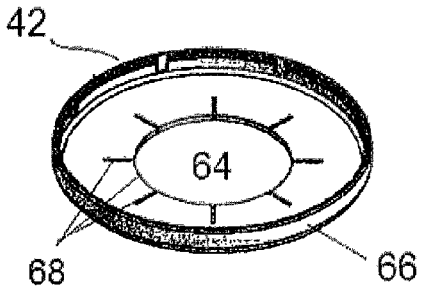
FIG. 6A is a perspective view of one embodiment of the lid.
Figure 6B:
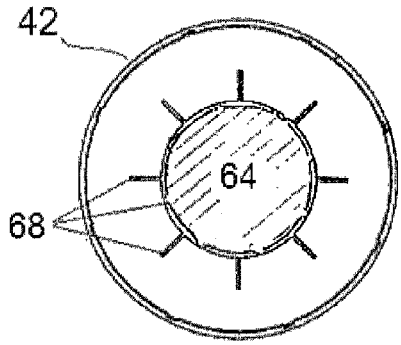
FIG. 6B is a bottom plan view of the lid of FIG. 6A showing the removable portion.
Figure 6C:
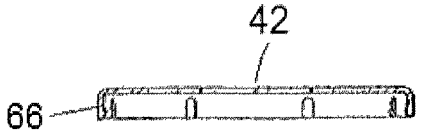
FIG. 6C is a sectional view of the lid of FIG. 6A.
Figure 6D:
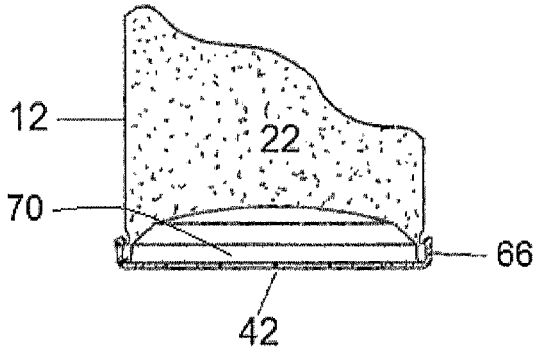
FIG. 6D is a sectional view of the lid of FIG. 6C attached to the base of the aerosol container.
Figure 7:
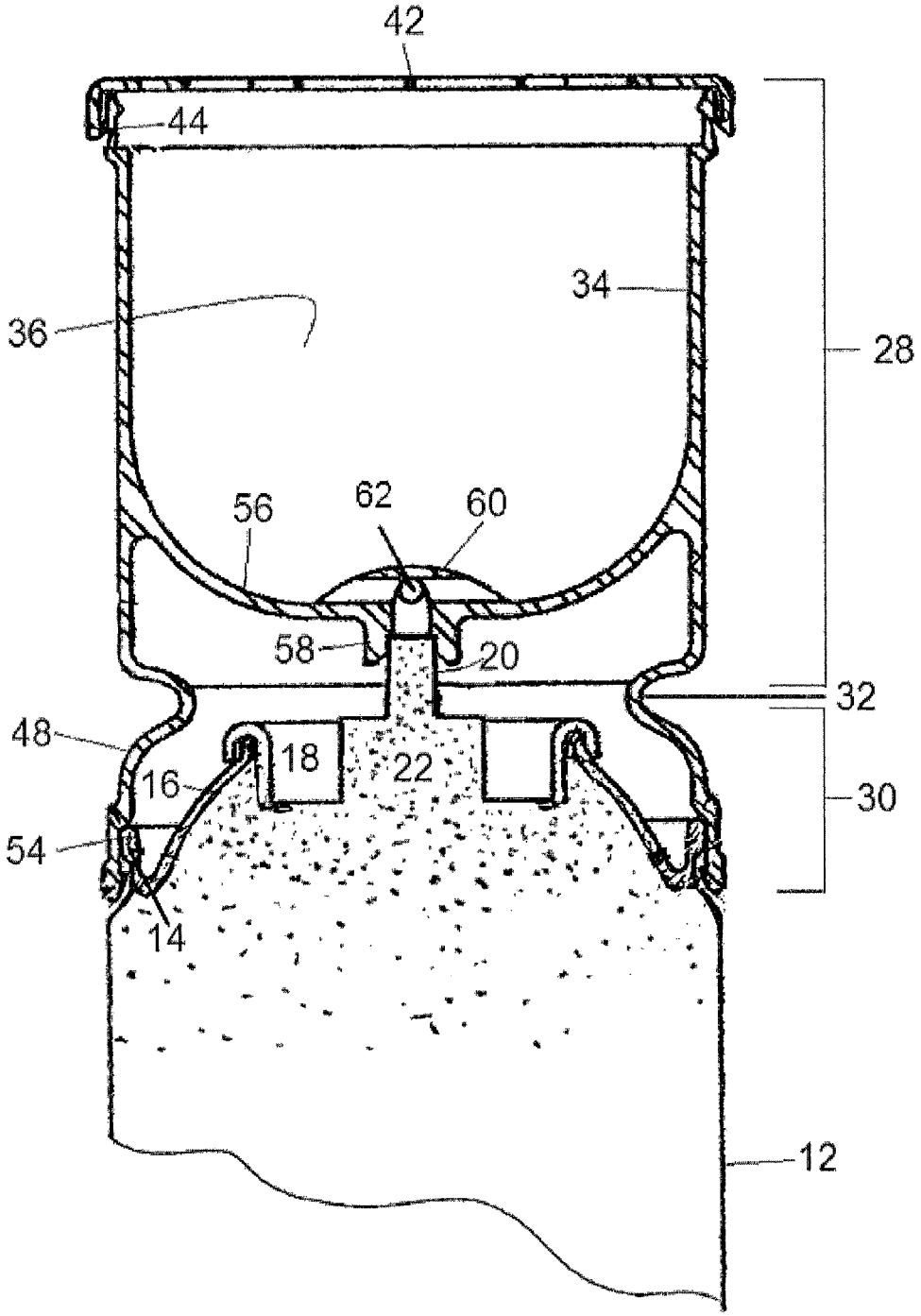
FIG. 7 is a sectional view of one embodiment of the present invention shown attached to an aerosol container in an actuating position wherein the valve of the container is open and product is dispensed.

The lid (42) is removably attachable to seal the first open end (38) of the receiving portion (28), the second open end (50) of the actuating portion (30), and the base (70) of the container (10). When attached to the second open end (50) of the actuating portion (30) as shown in FIG. 3, the lid (42) minimizes contamination of the actuating portion (30) after manufacturing and during shipping. When attached to the first open end (38) of the receiving portion (28) as shown in FIG. 7, the lid (42) prevents the product from spilling out of the receiving portion (28). When reversed and attached to the base (70) of the container (10) as shown in FIG. 6D, the lid (42) prevents rusting stains between the base (70) of the container (10) and a surface such as, for example, a shelf, basin, bathroom countertop, shower or bathtub base or edge, and the like.

The dimensions of the device (24) are not essential to the invention and may be increased or decreased as may be required to satisfy any particular design objectives; for example, the device (24) may be made available in a variety of dimensions to correspond with different sizes of aerosol containers. In one embodiment, the device (24) ranges between about 60 mm to about 80 mm in height, with the receiving portion (28) being about 40 mm to about 60 mm in height, and the actuating portion (30) being about 10 mm to about 30 mm in height. In one embodiment, the device (24) is about 70 mm in height, with the receiving portion (28) being about 50 mm in height, and the actuating portion (30) being about 20 mm in height. The depth of the device (24) may vary in accordance with the length of the grooming or cosmetic tool (74) intended for use with the device (24).

The device (24) may be formed of various flexible, elastic materials. As used herein, the term "flexible" means capable of bending without breaking. In one embodiment, the device (24) comprises flexible, elastomeric materials which can contract or widen. As used herein, the term "elastomer" means a material which exhibits the property of elasticity, namely the ability to deform when a stress is applied and to recover its original form (i.e., length, volume, shape, etc.) spontaneously when the stress is removed. Elastomers typically have a low Young's modulus (i.e., the ratio of tensile stress to tensile strain, expressed in units of pressure), and a high yield strain (i.e., the stress at which a material begins to deform plastically, expressed in units of pressure). Suitable elastomeric materials include, but are not limited to, polyisoprene or natural rubber, latex, polyurethane, polyethylene, and polyvinyl chloride. Such materials are durable, lightweight, and are relatively inexpensive.

It will be appreciated that the device (24) of the present invention is so simple but rugged in construction that it can be made at low cost. The device (24) may be easily fabricated. The device (24) is preferably of one-piece construction, and may be formed by a molding process including, but not limited to, injection molding and other processes known in the art. Briefly, material (for example, plastic) of which the device (24) is to be formed is fed into a heated barrel, mixed, and forced into a mold cavity where it cools and hardens to the configuration of the cavity. Once the material has hardened, the finished device (24) is released from the mold. Injection molding is a relatively simple and rapid process for producing the device (24).

As shown in the Figures, the device (24) is molded as a single, integral unit combining the receiving (28), actuating (30), and waist (32) portions. The lid (42) is manufactured separately as a component which is removably attachable to the device (24) or to the aerosol container (10). The device (24) is sufficiently durable to outlast several containers of product and thus can be sold separately as an accessory for use with aerosol containers. However, since the device (24) is relatively inexpensive to produce, a manufacturer may opt to include the device (24) with each aerosol container (10).

FIG. 7 shows one embodiment of the device (24) in use. The lid (42) is removed from the actuating portion (30) and secured to the first open end (38) to seal the receiving portion (28). The device (24) is reversed for use. Dispensing of the product (22) into the receiving portion (28) is achieved by positioning the actuating portion (30) over the rim (14) of the aerosol container (10) to align the protuberance (58) over the valve stem (20) of the container (10), and then applying a downward force on the device (24). The user may press downwardly on the first open end (38) or lid (42), or grasp and pull the side walls (34) downwardly. The force applied causes the second open end (50) of the actuating portion (30) to engage the rim (14) of the container (10) in a snap fit and compresses the waist portion (32). Compression of the waist portion (32) advances the end wall (56) towards the container (10) to enable the protuberance (58) to receive and frictionally engage the valve stem (20), thereby depressing the valve stem (20) to open the valve. The tight seal formed between the protuberance (58) and the valve stem (20) prevents the product (22) from leaking out. The product (22) within the container (10) travels upwardly in turn through the valve stem (20), the nozzle (not shown), the protuberance (58), the deflector (60) and the apertures (62) into the receiving portion (28).

When the downward force is removed, the waist portion (32) uncompresses or extends to its unactuated position, disengaging the protuberance (58) from the valve stem (20). The valve stem (20) is no longer depressed to open the valve. The spring (not shown) mounted within the container (10) biases the valve stem (20) to the unactuated position to close the valve, preventing further flow of product (22) into the receiving portion (28). The device (24) cannot be easily displaced or dislodged except by purposeful removal by the user. The user may grasp the device (24) and exert sufficient force to remove the device (24) from the aerosol container (10).

Figure 8:
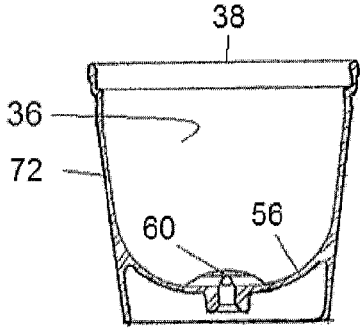
FIG. 8 is a sectional view of one embodiment of the present invention having sloping walls.

In another embodiment shown in FIG. 8, the waist portion (32) and side walls (34) are replaced by sloping walls (72) amenable for a single use. The user may push downwardly on the first open end (38) to open the valve to release the product (2) and remove the device (24) after dispensing a desired amount of product (22). Since the sloping walls (72) have been deformed, the device (24) may be disposed. The sloping walls (72) allow the device (24) to be stackable. Such a configuration may be suitable for single use in public washrooms, hotel rooms, airports, fitness or sports clubs, and the like. Company or team logos, marketing, or decorative elements may be incorporated with the invention. When fabricated by a molding process, the sloping walls (72) allow the device (24) to be rapidly and easily released from the mold.

The dispensed product (22) within the receiving portion (28) can be used immediately or mixed with one or more components which can be added directly into the receiving portion (28). As an example, a developer such as peroxide is typically added to color during hair coloring.

Figure 9:
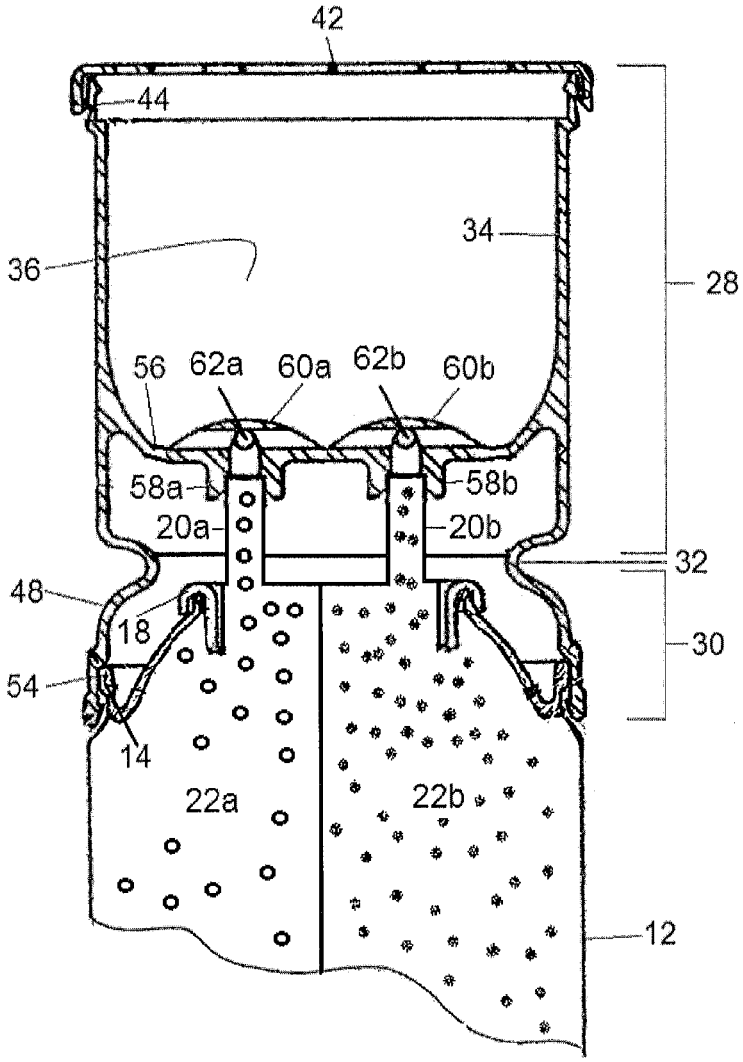
FIG. 9 is a sectional view of one embodiment of the present invention shown attached to an aerosol container having multiple valves in an actuating position wherein the valves of the container are open and multiple products are dispensed simultaneously.

In one embodiment shown in FIG. 9, the device (24) includes multiple protuberances (58) which are configured to receive and frictionally engage multiple valve stems (20) of a container (10) holding multiple products (22*a*, 22*b*). In one embodiment, the device (24) includes at least two protuberances (58*a*, 58*b*). The container (10) is shown to hold two different products (22*a*, 22*b*) within separate compartments of the body (12). Dispensing of both products (22*a*, 22*b*) simultaneously into the receiving portion (28) is achieved by positioning the actuating portion (30) over the rim (14) of the aerosol container (10) to align the protuberances (58*a*, 58*b*) over the respective valve stems (20*a*, 20*b*) of the container (10), and then applying a downward force on the device (24). The force applied causes the second open end (50) of the actuating portion (30) to engage the rim (14) of the container (10) in a snap fit and compresses the waist portion (32). Compression of the waist portion (32) advances the end wall (56) towards the container (10) to enable the protuberances (58*a*, 58*b*) to receive and frictionally engage the valve stems (20*a*, 20*b*), thereby depressing the valve stems (20*a*, 20*b*) to open the valves. Both products (22*a*, 22*b*) within the container (10) travel simultaneously upwardly in turn through the respective valve stems (20*a*, 20*b*), the nozzle (not shown), the protuberances (58*a*, 58*b*), the deflectors (60*a*, 60*b*) and the apertures (62*a*, 62*b*) to combine together within the receiving portion (28).

It will be appreciated by those skilled in the art that desired volumes of the products (22*a*, 22*b*) may be dispensed by varying for example, the number (density) or size (diameter) of the apertures (62*a*, 62*b*) of the deflectors (60*a*, 60*b*). As an example, if a recipe for hair coloring requires a greater volume of the first product (22*a*) compared to that of the second product (22*b*), the apertures (62*a*) through which the first product (22*a*) is dispensed may be increased in number or size compared to the apertures (62*b*) through which the second product (22*b*) is dispensed. Alternatively, the apertures (62*b*) through which the second product (22*b*) is dispensed may be decreased in number or size compared to the apertures (62*a*) through which the first product (22*a*) is dispensed. These modifications ensure that the first and second products (22*a*, 22*b*) are dispensed and combined in the correct proportions for the desired recipe.

In one embodiment, the device (24) comprises product level indicia corresponding to the volume of product(s) (22) contained therein, and displayed on the outer surface of the device (24) to provide the user with means to monitor or control the amount of product(s) and/or additional components dispensed and/or used.

Figure 10A:
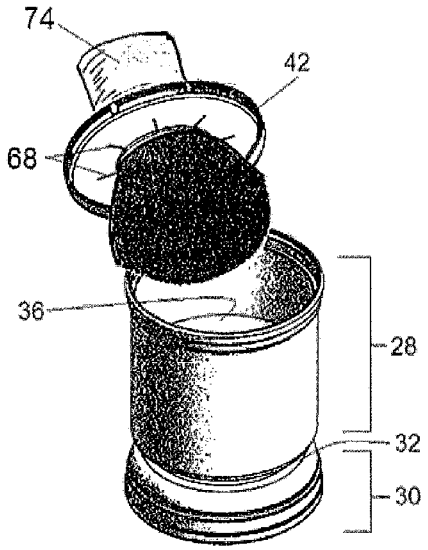
FIG. 10A is a perspective view of one embodiment of the present invention showing the device, and lid accommodating a grooming tool.
Figure 10B:
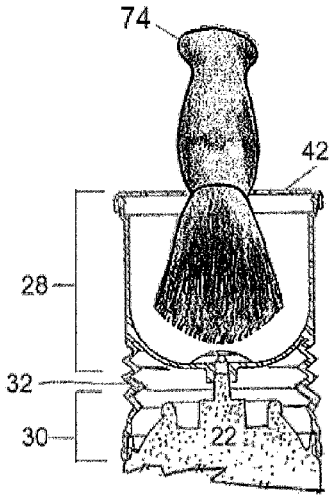
FIG. 10B is a sectional view of the embodiment of FIG. 10A attached to an aerosol container and showing the grooming tool in a storage position.

After use, the device (24) may be stored attached to the container (10). Any leftover product (22) can be stored for later use by placing the lid (42) over the device (24). As shown in FIGS. 10A-B, the removable portion (64) of the lid (42) may be removed to accommodate a grooming or cosmetic tool (74) (for example, a shaving brush) which may be stored between uses or during transit.

Figure 11A:
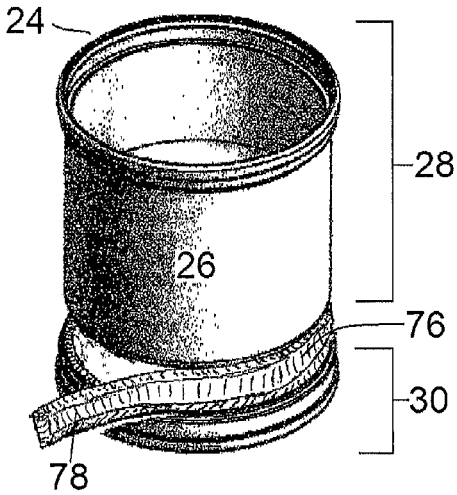
FIG. 11A is a perspective view of one embodiment of the present invention having a tear away band.
Figure 11B:
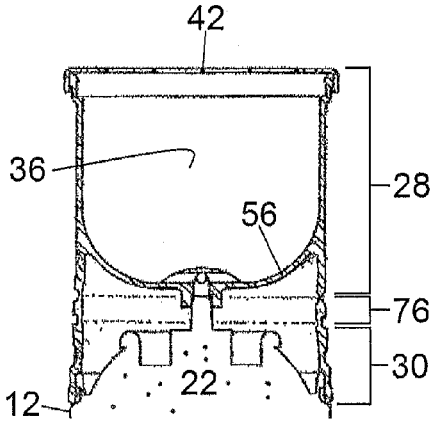
FIG. 11B is a sectional view of the embodiment of FIG. 11A attached to an aerosol container.
Figure 12:
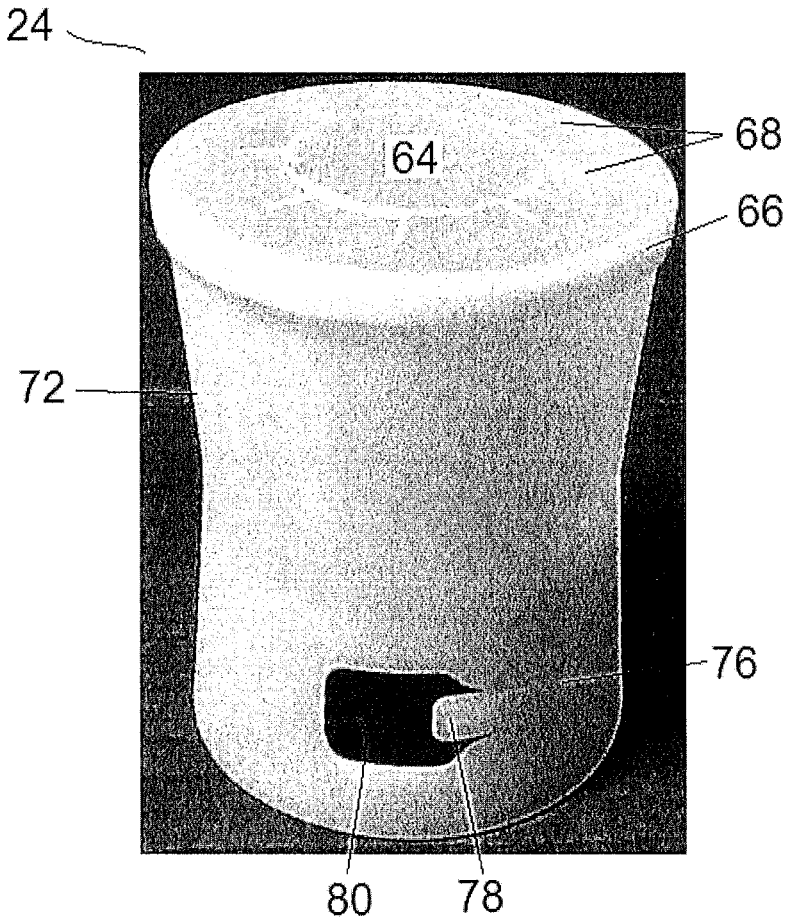
FIG. 12 is a perspective view of one embodiment of the present invention having sloping walls and a tear away band.

Alternatively, the receiving portion (28) of the device (24) may be removed from the container (10). In one embodiment shown in FIGS. 11A-B, the waist portion (32) comprises a circumferential tear away band (76). The tear away band (76) carries an outwardly protruding pull tab (78) integrally formed therewith to facilitate removal of the tear away band (76) from the device (24), and removal of the receiving portion (28). The tear away band (76) can thus be readily removed by manually grasping the pull tab (78) and tearing the band (76) from around the device (24). In one embodiment, the tear away band (76) extends around at least half or the entire circumference of the device (24). As previously described with reference to FIG. 8, the device (24) may have sloping walls (72). In another embodiment shown in FIG. 12, the device (24) has sloping walls (72) and a circumferential tear away band (76). An orifice (80) is defined in the wall (72) and sized to allow insertion of a user's thumb or finger for grasping the pull tab (78) and tearing the band (76) from around the device (24).

Confining the product(s) (22) within the receiving portion (28) thus enables more efficient use of the product(s) (22) by minimizing the time, waste, mess, and human contact typically encountered with products such as, for example, shaving creams which normally require gents to rinse and dry their hands repeatedly, and sun tanning or hair coloring products which typically discolor ladies' hands and fingernails. Once the container (10) is empty, the device (24) may be removed from the empty container to a new container full of the same or different product since most aerosol containers share the same dimensions.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

REFERENCES

All publications mentioned herein are incorporated herein by reference (where permitted) to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

Berghash, R. D. Combined dispenser cap and brush, U.S. Design Pat. No. 269,250, issued Jun. 7, 1963.

Byford, C. L. Combined dispenser can and shaving brush. U.S. Design Pat. No. 198,308, issued Jun. 2, 1964.

Hayes, T. H. Confining hand-held dispenser cap. U.S. Pat. No. 3,770,170, issued Nov. 6, 1973.

Karnuth, D. D. Brush attachment for shaving cream cans. U.S. Pat. No. 3,351,418, issued Nov. 7, 1967.

MacGibbon, D. A. and Cunningham, R. F. Shaving cream dispenser. U.S. Pat. No. 5,415,488, issued May 16, 1995.

McLennan, R. Foam shaving cream applicator. Canadian Patent No. 1,288,391, issued Sep. 3, 1991.

Nakamura, Y. and Furukawa, M. Aerosol container. U.S. Pat. No. 6,283,337, issued Sep. 4, 2001.

Velho, V. J. Shave cream applicator. Canadian Patent Application No. 2,654,696, published Dec. 14, 2006.

What is claimed is:

1. A device for removably mounting on an aerosol container comprising a valve, the device comprising:

a) a body which is substantially cylindrically-shaped comprising a receiving portion, an actuating portion, and a waist portion disposed there between, the body being reversible from an unactuating position wherein the valve is closed to prevent product flow, to an actuating position wherein the valve is opened to dispense product into the receiving portion; and b) a lid removably attachable to seal the receiving portion, actuating portion or base of the container;

wherein the actuating portion comprises tapered walls, and a second open end comprising a second outer annular shoulder sized to receive the lid, and a third inner annular shoulder capable of mating with a rim of the container.

2. The device of claim 1, wherein the receiving portion comprises side walls defining a bore, a first open end comprising a first outer annular shoulder sized to receive the lid, a first inner annular shoulder capable of mating with a rim of the container, and a second inner annular shoulder larger than the first inner annular shoulder.

3. The device of claim 2, wherein an end wall joins the side walls to separate the receiving portion from the actuating portion.

4. The device of claim 3, wherein the end wall defines at least one hollow protuberance configured to receive and frictionally engage at least one valve stem of the container.

5. The device of claim 4, wherein a generally dome-shaped deflector comprising one or more apertures is connected to the end wall in position over the protuberance.

6. The device of claim 5, comprising two protuberances and two deflectors.

7. The device of claim 1, wherein the waist portion comprises a plurality of collapsible joints.

8. The device of claim 1, wherein the waist portion comprises a circumferential tear away band carrying an outwardly protruding pull tab integrally formed therewith.

9. The device of claim 1, wherein the lid comprises a removable portion and a flange.

10. The device of claim 1, comprising sloping walls replacing the waist portion and side walls.

11. The device of claim 1, comprising an elastomer.

* * * * *